US005401006A

United States Patent [19]

Canner

[11] Patent Number: 5,401,006

[45] Date of Patent: Mar. 28, 1995

[54] QUENCH PRESS

[75] Inventor: Herman M. Canner, Bloomfield Hills, Mich.

[73] Assignee: Sterling-Detroit Company, Detroit, Mich.

[21] Appl. No.: 270,322

[22] Filed: Jul. 5, 1994

Related U.S. Application Data

[63] Continuation of Ser. No. 83,460, Jun. 28, 1993, abandoned.

[51] Int. Cl.[6] ..... C21D 9/00

[52] U.S. Cl. ..... 266/117; 266/118; 266/249; 266/259

[58] Field of Search ..... 148/646, 647, 658; 266/117, 118, 249, 259

[56] References Cited

U.S. PATENT DOCUMENTS 1,533,639 4/1925 Ehn ..... 266/117

FOREIGN PATENT DOCUMENTS 50-10523 4/1975 Japan ..... 266/117

*Primary Examiner*—Melvyn J. Andrews
*Assistant Examiner*—Sikyin Ip
*Attorney, Agent, or Firm*—Barnes, Kisselle, Raisch, Choate, Wittemore & Hulbert

[57] ABSTRACT

A method and press for uniformly quenching a heated annular workpiece while fixturing the workpiece to prevent distortion during quenching. The press has a conically shaped lower die for receiving a workpiece to be quenched thereon and a vertically reciprocable conically shaped upper die for clamping and fixturing a workpiece between them. The press has a generally cylindrical quench ring carried by the upper die for engaging against the lower die to form a chamber around the workpiece to immerse the workpiece in quenching fluid. The lower die has a plurality of spaced apart inlets for uniformly distributing quenching fluid around the workpiece and which are preferably angled relative to the center axis of the lower die for producing a swirling turbulent flow of fluid within the chamber to more rapidly and uniformly quench the workpiece.

13 Claims, 2 Drawing Sheets

QUENCH PRESS

This is a continuation of application Ser. No. 08/083,460, filed on Jun. 28, 1993, now abandoned.

FIELD OF THE INVENTION

This invention relates to heat treating annular workpieces and more particularly to a method and press for quenching an annular workpiece while fixturing it to minimize distortion of it during quenching.

BACKGROUND OF THE INVENTION

Finished workpieces are frequently quenched after being heated to impart to the workpiece a specific range of hardness, type of microstructure and other metallurgical and physical properties that are desirable for its intended use. Workpieces constructed of low carbon steel are typically quenched after being carburized during the finishing of the part. During carburization, the workpiece is heated to a high temperature and introduced into a carbon-rich atmosphere for diffusing a specific amount of carbon into the workpiece to control its surface (case) hardenability. After being carburized, the hot workpiece is quenched to rapidly lower its temperature to control the final microstructure formed during quenching to harden the workpiece, increase its fatigue resistance and impact toughness and impart other desirable physical properties to the workpiece.

Alternatively, work pieces made of high carbon steel (typically 1.0% C) need only be heated to the proper temperature for hardening by quenching. Carburizing is not required.

In the quenching of workpieces, a batch of workpieces is typically freely immersed in a tank filled with quenching fluid to reduce the temperature of each workpiece from near the carburizing or hardening temperature to a predetermined final temperature. While immersed, the temperature of each workpiece rapidly drops causing the microstructure of each workpiece to change. More importantly, the rate of cooling is rapid and carefully controlled to precipitate and permanently fix a desired microstructure in each workpiece when it reaches the final temperature. To increase the cooling rate for producing a more beneficial microstructure, such as martensite in steel, each workpiece or the fluid in the tank is typically agitated to induce turbulence in the fluid around each workpiece to increase the rate of heat transfer from each workpiece to the quenching medium.

Unfortunately, during quenching the workpieces may significantly distort or even crack rendering them unusable or typically requiring them to be later machined to their proper finished dimensions. Thin-walled workpieces, such as annular bearing races, are particularly vulnerable to distortion and cracking because their thin cross section causes difficulty in controlling the quench rate necessary to produce the desired final microstructure. As such, the scrapping of cracked or severely distorted quenched parts significantly increases manufacturing costs which in turn reduces profit. Equally financially burdensome is the significant labor and material cost associated with machining usually by grinding the hardened and distorted workpieces to their proper finished dimensions for use.

SUMMARY OF THE INVENTION

A method and quench press for uniformly quenching an annular workpiece while fixturing the workpiece to prevent distortion during quenching. The press has a lower die for receiving a workpiece to be quenched and a vertically reciprocable upper die for engaging the workpiece to position, clamp and fixture the workpiece between the lower and upper dies. The press has a generally cylindrical skirt or ring slidably telescopically carried by the upper die that engages against the lower die to form a quenching chamber around the workpiece to immerse the workpiece in quenching fluid to uniformly quench the workpiece.

Preferably the skirt or ring has tabs that extend downwardly from the bottom of the ring defining fluid outlet ports between the tabs to enable a high volume of quenching fluid to be continuously introduced into the chamber to more rapidly cool and quench the workpiece. Preferably, the ring carries a pneumatic nozzle for directing streams of compressed air onto the upper die to rapidly remove quench fluid remaining on the die after quenching to prepare it for engaging another workpiece.

Both the lower and upper dies have a base and a conical portion extending therefrom for engaging the radially inner edge of the axially outer faces of the workpiece to reduce the contact area and heat transfer between the dies and workpiece, urge the workpiece radially outwardly and constrain the workpiece to substantially reduce distortion during quenching. The conical portion of the upper die is preferably inclined to the upper die base at an acute included angle of about 35° so that the workpiece generally coaxially centers itself relative to both dies as it is being clamped. The conical portion of the lower die is preferably inclined to the lower die base at an acute included angle of about 15° to radially constrain the workpiece when clamped and yet provide greater clearance for workpiece grippers or carriers to load and unload workpieces onto and from the lower die.

Preferably, both the lower and upper dies have channels in their conical portions that are generally equiangularly circumferentially spaced apart and radiate outwardly from the center of each die to more evenly distribute quenching fluid around the inner and outer diametral surfaces of the workpiece to more uniformly quench the workpiece. The lower die has a plurality of circumferentially and radially spaced apart inlets that also uniformly distribute quenching fluid around the workpiece. The inlets are preferably angled relative to the center axis of the lower die for introducing a swirling turbulent flow of quenching fluid into the chamber during quenching to more rapidly and uniformly quench the workpiece.

In operation, a heated workpiece is loaded onto the lower die and the upper die is downwardly advanced until it engages the workpiece. As the upper die is further advanced, it centers the workpiece on the dies, clamps the workpiece between the dies and radially outwardly urges the outer axial edges of the workpiece thereby fixturing it to prevent distortion during quenching. When clamped, quenching fluid is introduced through the inlet bores into the quenching ring chamber to rapidly and uniformly quench the workpiece. After quenching is completed, the fluid is drained from the chamber and the upper die is retracted lifting the ring from the lower die. As the ring is lifted, compressed air is directed against the upper die to remove quenching fluid remaining on the upper die. When the ring and upper die are fully retracted, the workpiece is removed and thereafter another workpiece is loaded onto the lower die for quenching.

Objects, features and advantages of this invention are to provide a method and quench press which more uniformly and rapidly quenches an annular workpiece, significantly reduces workpiece distortion during quenching, fixtures the workpiece with minimum of heat transfer from the workpiece to reduce distortion during quenching, continuously circulates a large volume of cool quenching fluid around the workpiece to rapidly cool and quench the workpiece, circulates quenching fluid around the workpiece in a swirling turbulent flow condition to more uniformly and rapidly quench the workpiece, significantly reduces the labor and material required to make a finished hardened workpiece, and is rugged, durable, of simple design, of economical manufacture and easy to assemble and use.

BRIEF DESCRIPTION OF THE DRAWINGS

These and other objects, features and advantages of this invention will become apparent from the following detailed description, appended claims, and accompanying drawings in which:

DETAILED DESCRIPTION OF THE INVENTION

Figure 1:
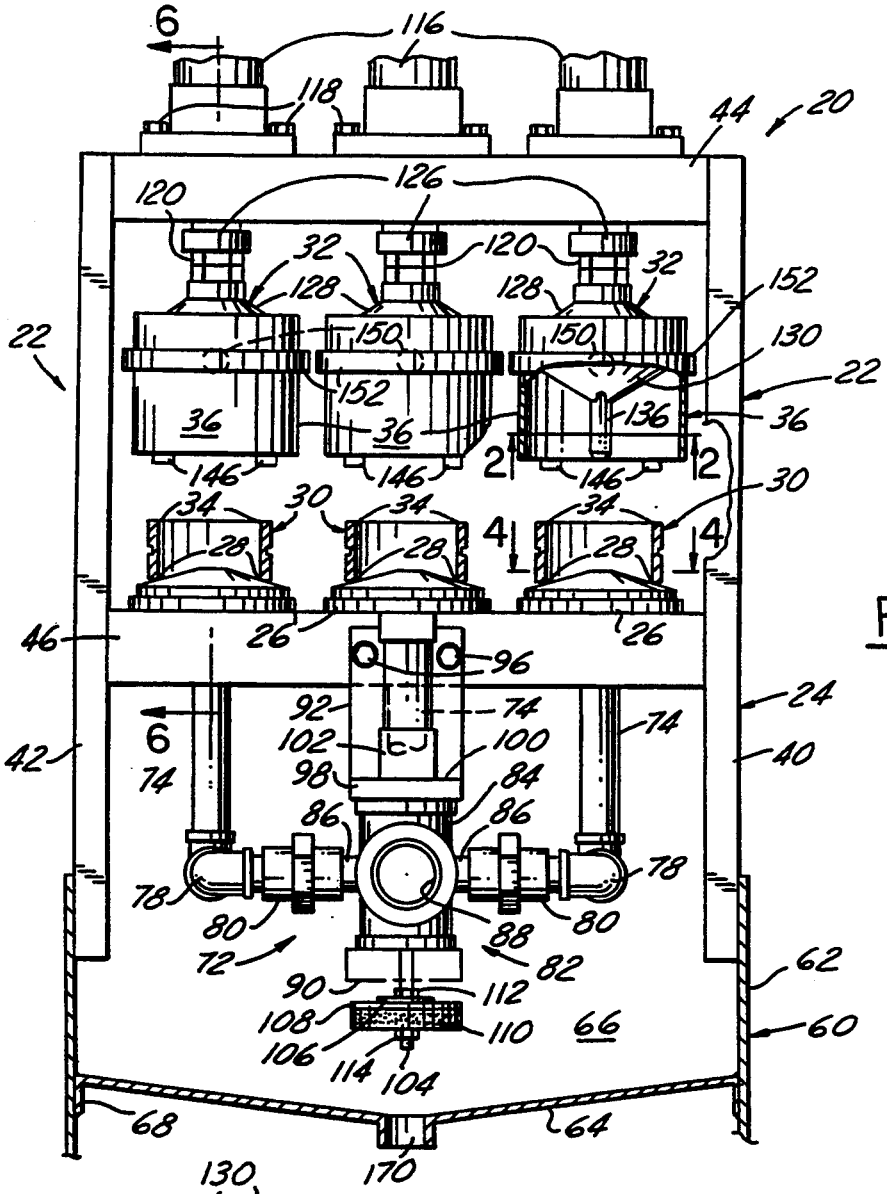
FIG. 1 is a front elevational view of three quenching presses of this invention mounted side-by-side in a supporting frame.

Referring in more detail to the drawings, FIG. 1 illustrates a quenching machine 20 that has a trio of quenching presses 22 of this invention which are spaced apart from each other and carried by a common supporting frame 24. Each quench press 22 has a lower die 26 for receiving an edge 28 of a generally annular workpiece 30, such as a cylindrical bearing race of steel, thereon and an upper die 32 overlying the workpiece 30 and lower die 26 for engaging an opposed edge 34 of the workpiece 30 to clamp the workpiece 30 between the dies 26, 32 to fixture the workpiece by radially constraining it to prevent workpiece distortion during quenching. Each press 22 has a generally cylindrical quench ring or skirt 36 that cooperates with both the dies when clamping the heated workpiece 30 to define a chamber 38 for receiving quenching fluid therein.

To quench the heated workpiece 30 while clamped, quenching fluid is rapidly introduced into the chamber 38 for quickly cooling the workpiece 30 to a temperature that produces the desired microstructure in the workpiece 30. After the workpiece 30 has been quenched, the fluid is drained from the chamber 38, the upper die 32 and ring 36 are retracted away from the lower die 26, the workpiece 30 is removed, and thereafter another heated workpiece to be quenched is loaded upon the lower die 26.

Figure 6:
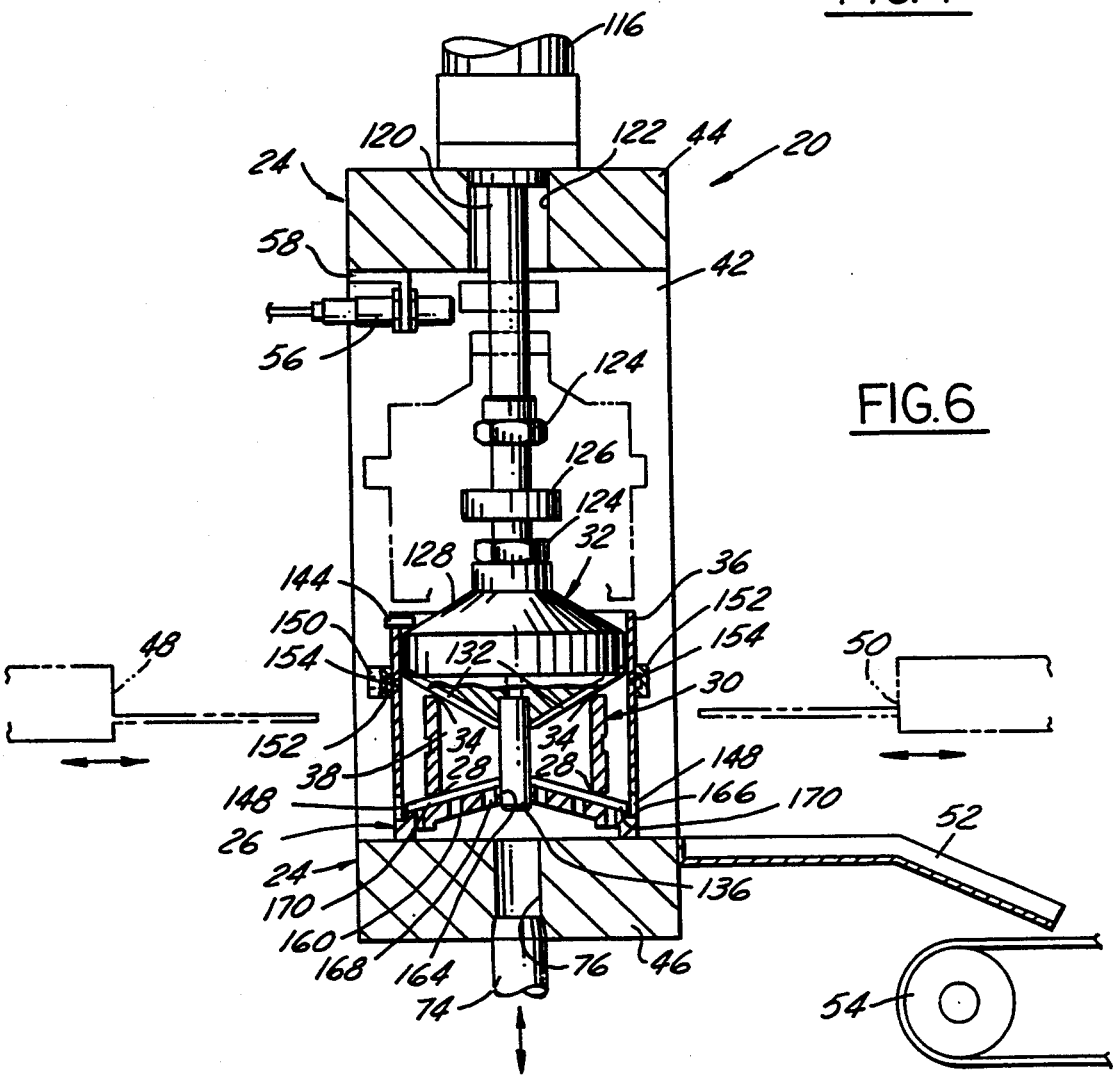
FIG. 6 is a longitudinal sectional view of the quench press taken along line 6—6 of FIG. 1.

The quench press frame 24 has a pair of vertical columns 40, 42 that are spaced apart adjacent their top ends by a horizontal crown 44 for supporting the upper die 32 of each press and along their spans by a horizontal bed 46 that carries the lower die 26 of each press. As illustrated in FIG. 6, a set of workpiece grippers 48 (in phantom) is associated with each press for facile insertion of a workpiece 30 onto the lower die 26 for quenching. When the quenching cycle is completed, the workpiece 30 is removed from the lower die 26 by another set of workpiece grippers 50 (located rearward of the frame 24 ) and placed upon an inclined slide 50 where the workpiece is transported to a moving conveyor belt 52. To extinguish any fire during operation, a fire extinguisher nozzle 56 is attached by a bracket 58 to the crown 44 adjacent each quench press 22 for blanketing the press 22 with a fire retardant should the quenching fluid reach its flash point temperature and ignite.

Adjacent the lower end of each column 40, 42 and underlying the quench press bed 46 is a sump pan 60 for receiving hot quenching fluid after being drained from the chamber 38 of each press 22. The sump pan 60 has two pairs of opposed sidewalls 62 and a bottom wall 64 defining a sump basin 66 for receiving the quenching fluid after it has been circulated through the quench presses. Preferably, the bottom wall 64 has a flange 68 extending downwardly about its outer periphery that is preferably welded to the sump sidewalls. To facilitate recirculation of used quenching fluid, the bottom wall 64 of the sump 60 has a drain spout 70 coupled to piping (not shown) that leads to a heat exchanger (not shown) for cooling the quenching fluid so it can be reused.

Quenching fluid is delivered to the chamber 38 of each press through a manifold 72 and a two-way valve 74 by a pump (not shown), connected to a holding tank (not shown), which receives cool quenching fluid from the heat exchanger. As shown in FIG. 6, quenching fluid is supplied to each chamber 38 through its lower die 26 which communicates with a port 76 in the bed. The manifold is connected to each chamber through a pipe 78, elbows 80 and a coupling 82.

The valve has a body 84 with an inlet 86 for receiving cool quenching fluid, a first outlet 88 communicating with the manifold, and a second outlet 90 for dumping the output of the quench pump into the sump 66 when quenching is completed. The valve body 84 is secured to the frame 24 by a generally L-shaped plate 92 with one leg 94 secured to the press bed 46 by a pair of spacer bolts 96 and the other leg 98 forming a horizontal platform 100 to which the valve body and a fluid powered actuator cylinder 102 are attached. Preferably, the valve 82 is a two-way lifting-type valve with the actuator cylinder piston rod 104 extending through the valve outlet 90 with a washer 106, sealing gasket 108 and a circular backing disk 110 sandwiched between a pair of nuts 112 & 114 threadably received on the rod 104 adjacent its free end. In operation, the actuator cylinder retracts its rod 104 upwardly to abut the gasket 108 against the valve body 84 to seal the outlet 90 when supplying each chamber 38 with quenching fluid and extends the rod 104 downwardly to open the valve outlet 90 to dump the hot fluid into the sump basin 66 when the quenching cycle is completed. Preferably, the quenching fluid is continuously supplied to the valve 82 by the pump and simply dumped into the sump basin 66 when the valve is open.

The upper die 32 of each press 22 is vertically reciprocated during press operation by a fluid actuated drive cylinder 116 mounted on the crown 44 by bolts 118. As shown in FIG. 6, each drive cylinder 116 has a vertically reciprocable piston rod 120 extending through an opening 122 in the crown 44 with its free end threadably attached by a hexagonal fitting 124 to the upper die 32 for cycling the upper die 32 between its retracted position (shown in phantom) to load a workpiece 30 onto the lower die 26 and its clamping position shown in solid lines. Preferably, the piston rod 120 has a protective annular stop 126 thereon between the upper die 32 and the frame 24 for preventing the upper die 32 from being retracted against the crown 44 and damaged.

Figure 2:
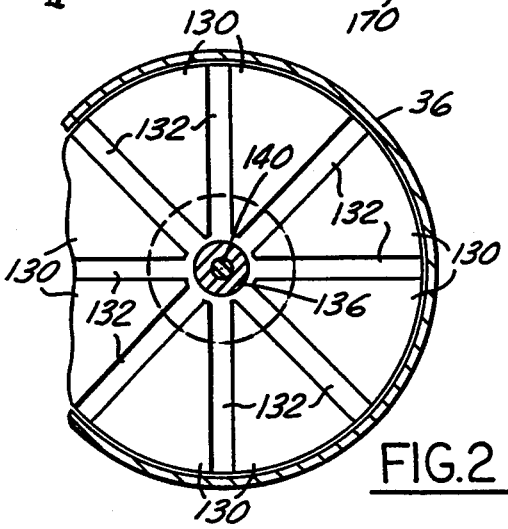
FIG. 2 is a fragmentary top view of an upper die of one of the quench presses taken along line 2—2 of FIG. 1.
Figure 3:
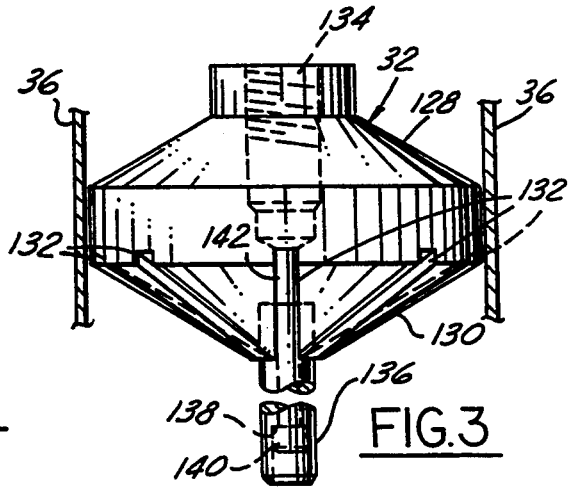
FIG. 3 is a side view of the upper die.

Referring to FIGS. 2 & 3, the upper die 32 has a base 128 with a conical portion 130 for bearing against radially inner edge 34 of the workpiece 30 (FIG. 6) when clamped to urge the edge of the workpiece 30 radially outwardly and fixture the workpiece 30 to prevent the workpiece 30 from distorting during quenching. Preferably, the upper die 32 has a series of equally circumferentially spaced apart channels 132 in the conical portion 130 that radiate radially outwardly from the center of the conical portion for facilitating the even distribution of quenching fluid around the inner and outer surfaces of the workpiece 30.

The upper die 32 is mounted on the piston rod 120 by a coaxial threaded bore 134 in the die base. To maintain coaxial alignment of the dies 26 & 32 while clamped, a locator pin 136 extends downwardly from the conical portion 30 of the upper die 32. The locator pin 136 is received in a counterbore 138 of the upper die and secured therein by a cap screw 140 extending through a bore and counterbore in the pin and received in a complementarily threaded bore 142 in the upper die.

As illustrated in FIG. 6, when clamped, the conical portion 130 of the upper die 32 contacts only the radially inner edge 34 of the axially outer surface of the workpiece 30 to minimize the contact surface area between the workpiece 30 and die 32 for reducing heat transfer from the workpiece to the upper die and preventing workpiece distortion. Preferably, the conical portion 130 is inclined to the die base 128 at an acute included angle of about 15° to 45° and preferably 30° to 35° so that the workpiece 30 generally coaxially centers itself relative to the lower and upper dies 26, 32 as it is being engaged by the upper die 32 during clamping for ensuring proper clamping of the workpiece 30 to fixture and uniformly radially outwardly urge the edges of the workpiece 30 when clamped.

As is shown in FIGS. 3 & 6, the ring or skirt 36 is of generally cylindrical thin walled construction and is carried by the upper die 32 to form the quenching fluid chamber 38 around the workpiece 30 during clamping. To accommodate workpieces of varying axial length, the ring 36 is slidably telescopically received on the upper die 32 to allow the upper die 32 to move axially relative to the ring 36 after the ring 36 bears on the lower die 26 during clamping. The ring 36 is retained on the upper die by a plurality of circumferentially spaced apart stop pins 144 projecting through the ring adjacent its upper edge and bearing on the die when it is retacted.

The ring 36 preferably has four circumferentially spaced apart tabs 146 projecting downwardly from its lower edge and defining outlet ports 148 (FIG. 6) between the tabs when the ring 36 is received on the lower die to permit quenching fluid to flow out of these ports 148 and into the sump basin 66 during quenching. This permits a large volume of cool quenching fluid to be pumped through the chamber 38 to more rapidly cool the workpiece 30 while helping to induce turbulent flow within the chamber 38 to increase heat transfer from the workpiece 30 to the fluid. To more completely drain the fluid from the chamber 38 after quenching is complete, the ring 36 has a pneumatic nozzle 150 with an annular generally U-shaped pneumatic distribution ring 152 encircling the ring 36 and overlying a plurality of bores 154 in the sidewall of the ring 36 for injecting streams of compressed air generally radially inwardly onto the conical portion 130 of the upper die 32 to rapidly remove fluid therefrom to insure that the next hot woripiece loaded for quenching will not be contacted by fluid remaining on or dripping from the upper die 32 and cause a fire, distort the hot workpiece or both. Preferably, the ring 36 trips a limit switch (not shown) for triggering the air injection fluid removal cycle when the upper die 32 is raised.

Figure 5:
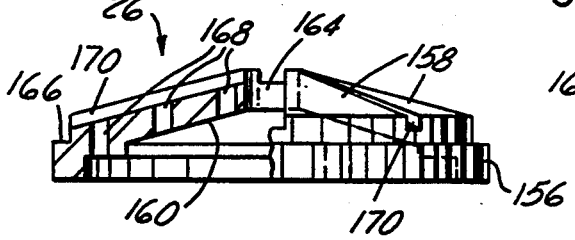
FIG. 5 is a fragmentary side view partially in section of the lower die taken along line 5—5 of FIG. 4.
Figure 4:
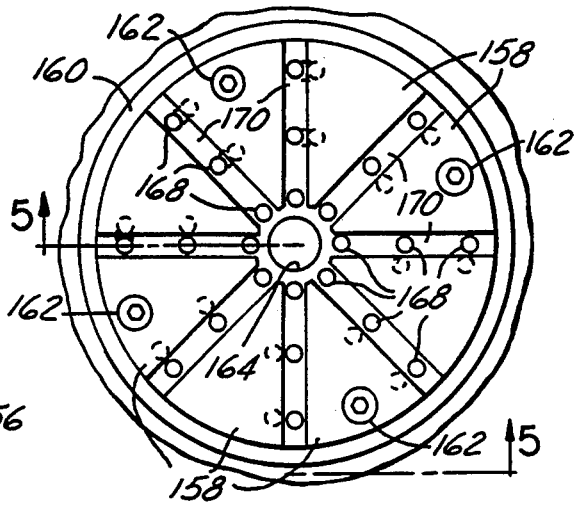
FIG. 4 is a top view of a lower die of the quench press taken along line 4—4 of FIG. 1.

Referring to FIGS. 4, 5 & 6, the lower die 26 has a base 156 with a conical portion 158 for bearing against the radially inner edge 28 of the workpiece 30 when clamped to urge the workpiece 30 radially outwardly and fixture the workpiece 30 to prevent the workpiece 30 from distorting during quenching. The conical portion 158 of the lower die 26 is preferably inclined to the lower die base 156 at an acute included angle of 15° to 45° and preferably 15° to 20° to center and constrain the workpiece 30 when clamped and yet provide increased clearance for the workpiece grippers 48, 50 to load and unload workpieces onto and from the lower die 26.

The lower die 26 has a cavity 160 that overlies the quenching fluid inlet 76 in the press bed 46 when the die 26 is mounted on the bed 46 by four circumferentially spaced apart cap screws 162. To achieve concentric alignment between the lower and upper dies 26, 32 during clamping, the lower die 26 has a locator bore 164 on the axis of the conical portion 158 for receiving the locator pin 136 extending from the upper die 32. To telescopically slidably receive the ring tabs 146 while generally coaxially centering the ring 36 over the lower die 26, the die 26 has a recessed ledge 166 about the periphery of the conical portion 158.

To facilitate uniformly distributing quenching fluid within the chamber 38 during quenching and draining the fluid after quenching, the lower die 26 has a plurality of spaced apart fluid outlet bores 168 that extend through the conical portion 158 into the cavity 160 in the underside of the die 26. Preferably, the outlets 168 are arranged in groups of three radially spaced apart and angularly aligned inlets to form three concentric rings of outlets preferably equally circumferentially spaced apart for uniformly distributing quenching fluid around both the inner and outer diametral surfaces of workpieces of varying diameters. Preferably, as shown in FIG. 4, each outlet bore 168 is canted at approximately a 30° angle relative to the center axis of the lower die 26 so that the outlets 168 create a generally swirling flow pattern of fluid entering the chamber 38 to more uniformly quench the workpiece 30 while simultaneously inducing turbulence in the fluid flow to more rapidly quench the workpiece 30.

Preferably, the lower die 26 has a series of equally circumferentially spaced apart channels 170 in the conical portion 158 that extend radially outwardly from the locator opening 164 for further facilitating the even distribution of quenching fluid around the workpiece 30. Preferably, each grouping of radially outwardly aligned outlets 168 are positioned within a channel to further improve quenching fluid distribution around the workpiece 30.

In operation, initially the upper die 32 and quench ring or skirt 36 are retracted to the position shown in phantom in FIG. 6 to enable workpiece grippers 48 to facilely insert a hot workpiece 30 onto the lower die 26 to be quenched. After the grippers 48 have been disengaged from the workpiece 30 and retracted from the press 22, the drive cylinder 116 is actuated to extend its piston rod 120 downwardly until the conical portion 130 of the upper die 32 contacts the workpiece 30. As the conical portion 130 of the upper die 32 initially engages the workpiece 30, it centers the workpiece 30 on the lower die 26 so that it is concentric with both the lower and upper dies 26, 32. The upper die 32 is further extended until the workpiece 30 is firmly clamped between both dies 26, 32 fixturing the workpiece 30 for quenching. When clamped, the conical portions 130 & 158 of the upper and lower dies 32 & 26 urge the radially inner edges 34, 28 of the axially outer top and bottom workpiece surfaces radially outwardly to radially and axially constrain the workpiece 30 to prevent the workpiece 30 from distorting during quenching.

During clamping, the quench ring 36 is lowered with the upper die 32 until its tabs 146 bear on the ledge 166 of the lower die 26. When clamping is completed, the two-way valve 74 is closed by actuator 102 and quenching fluid is rapidly directed into the die cavity 160, through the inlet bores 168 in the lower die 26 and into the chamber 38 of the press 22 preferably in a swirling flow pattern to uniformly quench the workpiece 30. As quenching fluid is pumped into the chamber 38, fluid is preferably simultaneously draining out of the ports 148 in the quench ring 36 and into the sump basin 66 enabling a relatively large volume: of turbulent quenching fluid to pass through the chamber 38 to more rapidly quench the workpieces 30.

When quenching is completed, the two-way valve 74 is opened to rapidly drain the remaining fluid from the chamber 38 through the manifold 72 and into the sump basin 66 and direct the fluid from the quench pump into the sump 66. The fluid also drains through the ports 148 in the quench ring. After quenching is completed and preferably during the draining of the quenching chamber 38, the drive cylinder 116 is actuated to lift the upper die 26 away from the lower die 32 and unclamp the workpiece 30. As the upper die 32 is being retracted, it also lifts the quench ring 36 from the lower die 26. As the upper die 32 is retracted, preferably compressed air is discharged by the pneumatic nozzle 150 through the bores 154 and onto the conical portion 130 of the upper die 32 to remove any remaining quenching fluid from the die 32 to prepare it for engaging the next heated workpiece.

When the upper die 32 reaches the retracted position shown in phantom in FIG. 6, workpiece grippers 50 remove the workpiece 30 and place it on the slide 52 where it is directed to the conveyor belt 54 and transported away from the quench press machine 20. Upon removing the workpiece 30, another hot workpiece is preferably loaded onto the lower die 26 by the grippers 48 and thereafter another quenching cycle is initiated.

This press and method of quenching hot annular workpieces so significantly reduces distortion that for a typical bearing race, after hardening, substantially less material must be removed to provide concentric peripheral surfaces. Consequently, the radial thickness of the machined ring before hardening can usually be reduced about 0.015 to 0.020 of an inch. This results in significant savings in material, labor, machining and finish grinding.

What is claimed is:

1. An apparatus for quenching an annular workpiece having axially spaced apart and opposed ends with radially inner edges and inner and outer surfaces extending between the ends, comprising: a lower die having a base and a conical portion for receiving an inner edge of the annular workpiece thereon, an upper die having a base and an opposed conical portion for overlying and bearing on an axially spaced apart and opposed inner edge of the annular workpiece, said dies being relatively movble to an open position to receive the annular workpiece between them and a closed position to engage the opposed inner edges of the annular workpiece and clamp it between them, said conical portions being inclined to the inner and outer surfaces of the workpiece so that they are spaced from and do not engage either of the inner surface and the outer surface of the workpiece when its radially inner edges are engaged by said conical portions of said dies, the surface of the conical portion of each of said dies which engages an inner edge of the annular workpiece being inclined to the base of its associated conical portion at an acute included angle of about 15° to 45° , a quench ring operably cooperating with said lower die and said upper die to provide a chamber surrounding the annular workpiece for receiving quenching fluid to quench the annular workpiece in the chamber, said quench ring having a larger inside diameter than the workpiece and encircling and being spaced from and not engaging the workpiece when received in the chamber, and an inlet opening into the chamber for rapidly introducing quenching fluid into the chamber in contact with both the inner and outer surfaces of the annular workpiece to quench the annular workpiece while clamped between the dies.

2. The workpiece quenching apparatus of claim 1 wherein said inlet comprises a plurality of fluid passages in one of said dies for introducing quenching fluid into the chamber.

3. The workpiece quenching apparatus of claim 2 wherein said fluid passages are spaced apart from each other and constructed and arranged to distribute the quenching fluid about an inner diameter and an outer diameter of the workpiece to more uniformly quench the workpiece.

4. The workpiece quenching apparatus of claim 3 wherein said fluid passages are constructed and arranged to induce turbulent flow of the quenching fluid in the chamber, so that the rate of cooling of the workpiece being quenched in the chamber is increased.

5. The workpiece quenching apparatus of claim 4 wherein said upper and lower dies each have a plurality of channels therein for more evenly distributing quenching fluid around the workpiece within the chamber to more uniformly quench the workpiece.

6. The workpiece quenchilng apparatus of claim 1 which also comprises at least one nozzle carried by said quench ring for injecting a stream of air onto said upper die to rapidly remove quenching fluid from said upper die.

7. The workpiece quenching apparatus of claim 1 wherein said lower die has a base and said conical portion of said lower die is carried by said base for receiving workpieces of varying diameters and is inclined to said base at an acute included angle.

8. The workpiece quenching apparatus of claim 7 wherein said conical portion of said lower die is inclined to said base at an acute included angle of 15° to 20° to facilitate insertion of the workpiece onto said lower die.

9. The workpiece quenching apparatus of claim 1 wherein said upper die has a base and said conical portion of said upper die is carried by said base for engaging workpieces of varying diameters and is inclined to said base at an acute included angle.

10. The workpiece quenching apparatus of claim 9 wherein said conical portion of said upper die is inclined to said base at an acute included angle of 30° to 35°.

11. An apparatus for quenching an annular workpiece having axially spaced apart and opposed ends with radially inner edges and inner and outer surfaces extending between the ends, comprising: a lower die having a base and a conical portion for receiving an inner edge of an annular workpiece thereon, an upper die having a base and an opposed conical portion for overlying said lower die and bearing on an axially spaced apart and opposed inner edge of the annular workpiece, said upper die being reciprocable between an open position for allowing an annular workpiece to be placed on said lower die and a closed position for clamping the annular workpiece between said upper and lower dies, said conical portions of said dies being inclined to the inner and outer surfaces of the workpiece so that they are spaced from and do not engage either of the inner surface and the outer surface of the workpiece when its radially inner edges are engaged by said conical portions of said dies, the surface of the conical portion of each of said dies which engages an inner edge of the annular workpiece being inclined to the base of its associated conical portion at an acute included angle of about 15° to 45°, a quench ring carried by said upper die for encircling the conical portion of said lower die when said upper die is in said closed position so they define a chamber encompassing the workpiece for receiving a fluid therein to quench the workpiece when said upper die is in said closed position, said quench ring having a larger inside diameter than the workpiece and encircling and being spaced from and not engaging the workpiece when received in the chamber, and at least one fluid passageway in said lower die and opening into the chamber for introducing quenching fluid into said chamber when said upper die is in said closed position.

12. The workpiece quenching apparatus of claim 11 which also comprises a drive operably connected to said upper die for reciprocating said upper die between said open and closed positions.

13. The workpiece quenching apparatus of claim 11 which also comprises a locator pin carried by said upper die for being received in a locator opening in said lower die to accurately align said conical portions of said upper and lower dies when said upper die is in its closed position.

* * * * *